US005448896A

United States Patent [19]

Rushing

[11] Patent Number: 5,448,896

[45] Date of Patent: Sep. 12, 1995

[54] SHELF MOUNTED REFRIGERATED DISPLAY UNIT

[75] Inventor: Tatsuo Rushing, Denville, N.J.

[73] Assignee: HMG Worldwide In-Store Marketing, Inc., New York, N.Y.

[21] Appl. No.: 203,808

[22] Filed: Mar. 1, 1994

[51] Int. Cl.[6] ..... A47F 3/04

[52] U.S. Cl. ..... 62/255; 62/457.9

[58] Field of Search ..... 62/255, 251, 252, 457.9

[56] References Cited

U.S. PATENT DOCUMENTS

| | | | |
|---|---|---|---|
| 2,503,419 | 4/1950 | Secunde | 62/251 X |
| 3,027,735 | 4/1962 | Preotle et al. | 62/407 |
| 3,638,449 | 2/1972 | Lichtenberger | 62/407 X |
| 4,270,819 | 6/1981 | Ooho | 62/255 X |
| 4,628,697 | 12/1986 | Bruck et al. | 62/255 X |
| 4,637,222 | 1/1987 | Fujiwara et al. | 62/457.9 X |
| 5,301,517 | 4/1994 | Bustos | 62/255 X |

*Primary Examiner*—William E. Tapolcai

*Attorney, Agent, or Firm*—Cohen, Pontani, Lieberman, Pavane

[57] ABSTRACT

A portable refrigerated display case adapted to be positioned upon a shelf or other elevated support surface includes a main housing defining an enclosed display area for displaying beverages or other food products and an integral refrigeration system. In a first embodiment, the entire refrigeration system is self contained within the display housing. In a second embodiment, only the evaporator portion is disposed within the display housing, with the remainder of the refrigeration system being disposed within a remotely positionable housing and connected to the evaporator portion by a pair of flexible houses.

11 Claims, 4 Drawing Sheets

SHELF MOUNTED REFRIGERATED DISPLAY UNIT

BACKGROUND OF THE INVENTION

1. Field of the Invention

This invention relates generally to refrigerated display systems, and more particularly to a portable, refrigerated, point-of-use display positionable on a shelf or other elevated support surface.

2. Description of the Prior Art

Refrigerated display cases have long been utilized in supermarkets, butcher shops, and the like to cool and display food products and beverages for sale to consumers. Display cabinets of this type typically have an elongated hollow configuration within which the food products are contained and are occasionally enclosed by one or more sliding window panels that extend forwardly and downwardly from a top of the cabinet. Displays of this type, however, are designed to be free-standing and may be from four to eight feet wide and approximately three feet deep. As will be readily appreciated, such displays are also quite heavy and require special floor layout accommodations to ensure consumer access without substantially interfering with foot traffic to other areas of the store. As such, this type of display is generally placed at the outer boundaries of a shopping area, i.e., proximate a wall, etc.

In an effort to influence consumers standing in line at the check-out counter to make a "last-minute" purchasing decision, smaller refrigerated display cabinets designed to be positioned near the check-out lines have also been utilized. Such cabinets typically occupy a two foot by two foot area. Thus, although the smaller cabinet design occupies substantially less space than the elongated configurations discussed above, they are still large enough to interfere with foot traffic. As such, displays of this type can only be placed where space permits and often necessitate substantial floor layout modifications to avoid obstructing foot traffic through the store.

U.S. Pat. No. 3,552,138 issued Jan. 5, 1971 to Davis discloses a "REFRIGERATED DISPLAY UNIT", which is an auxiliary display case mounted in front of and against the front case wall of a conventional or existing refrigerated grocery case. A U-shaped conduit is fitted over the back wall of the auxiliary case and the front wall of the existing case and is provided with some type of pump for moving cool air from the front portion of the existing case into the rear portion of the auxiliary case. While the display unit disclosed by Davis is physically small enough to fit on a shelf, in practice, it cannot be so positioned because it requires an external supply of refrigerated air and is peculiarly adapted for mounting on an existing grocery case. It therefore suffers from the same placement limitations as the other cases discussed above.

It is therefore an object of the present invention to provide a refrigerated display which can be positioned on any shelf and which can thus be moved to any desired location in a retail environment without necessitating the extensive floor layout modifications characteristic of prior art refrigerated displays.

SUMMARY OF THE INVENTION

The aforementioned object, as well as other benefits and advantages which will become apparent to those skilled in the art, are provided by a refrigerated display unit which includes a main display housing defining a chamber and a display area having a bottom interior surface, opposed interior side surfaces, and a rear interior surface. The main display housing also includes a transparent cover for enclosing the display area. The transparent cover is pivotably secured to the main display housing and defines upper and front interior surface portions of the display area to provide maximum visibility of the products contained therein. A refrigeration system is further included for supplying refrigerated air to the display area and comprises a fan situated within the chamber for recirculating air through the chamber and the enclosed display area and an evaporator unit positioned proximate the fan for cooling the recirculated air.

To facilitate the recirculation of air within the main display housing, a first of the display area interior surfaces defines an intake duct for receiving the refrigerated air and a second of the interior surfaces defines an exhaust duct for supplying spent air to the chamber. To prevent recirculated air from bypassing the evaporator unit, a plenum is preferably disposed between the intake duct and evaporator unit. The plenum receives air cooled by the evaporator and communicates with the intake duct to provide flow of the cooled air therethrough.

In accordance with an illustrative embodiment of the present invention, the bottom interior surface of the display area defines the intake duct and the rear interior surface of the display area defines the exhaust duct. The intake duct comprises a plurality of elongated slots defined in the first interior surface and the exhaust duct comprises a plurality of apertures defined in the second interior surface. The chamber includes a first section disposed beneath the bottom interior surface and a second section disposed behind the rear interior surface. The display area and the first and second chamber sections are separated by respective walls, with opposite surfaces of each respective wall defining an interior surface of a chamber section and an interior surface of the display area, respectively. The first and second chamber sections are in fluid communication with the enclosed display area and with each other to permit recirculating air flow therebetween.

In accordance one embodiment of the present invention, the main display housing further defines a second chamber in which other components of the refrigeration system, including a condenser unit and a compressor unit, are disposed. An insulating barrier is preferably interposed between the respective chambers so that heat released by the condenser unit in the second chamber does not impede cooling of the recirculated air within the first chamber.

In accordance with an alternate embodiment of the present invention, the refrigerated display unit further includes a second housing positionable remotely from the main display housing and defining an interior chamber dimensioned to accommodate the condenser and compressor units of the refrigeration system. To permit selective positioning of the second housing relative to the main display housing, a display unit constructed in accordance with the alternate embodiment further includes refrigerant flow connecting means in the form of flexible hoses for coupling the evaporator to the condenser and compressor units.

In yet another embodiment of the present invention, a plurality of main display housings are included, each having an evaporator section coupled to a common condenser/compressor unit by respective pairs of flexible hoses. The common condenser and compressor unit is disposed within the interior of a remotely positionable housing.

BRIEF DESCRIPTION OF THE DRAWING

Other objects and advantages of the invention will become apparent upon reading the following detailed description and upon reference to the annexed drawings, in which.

DETAILED DESCRIPTION OF THE PREFERRED EMBODIMENTS

Figure 1:
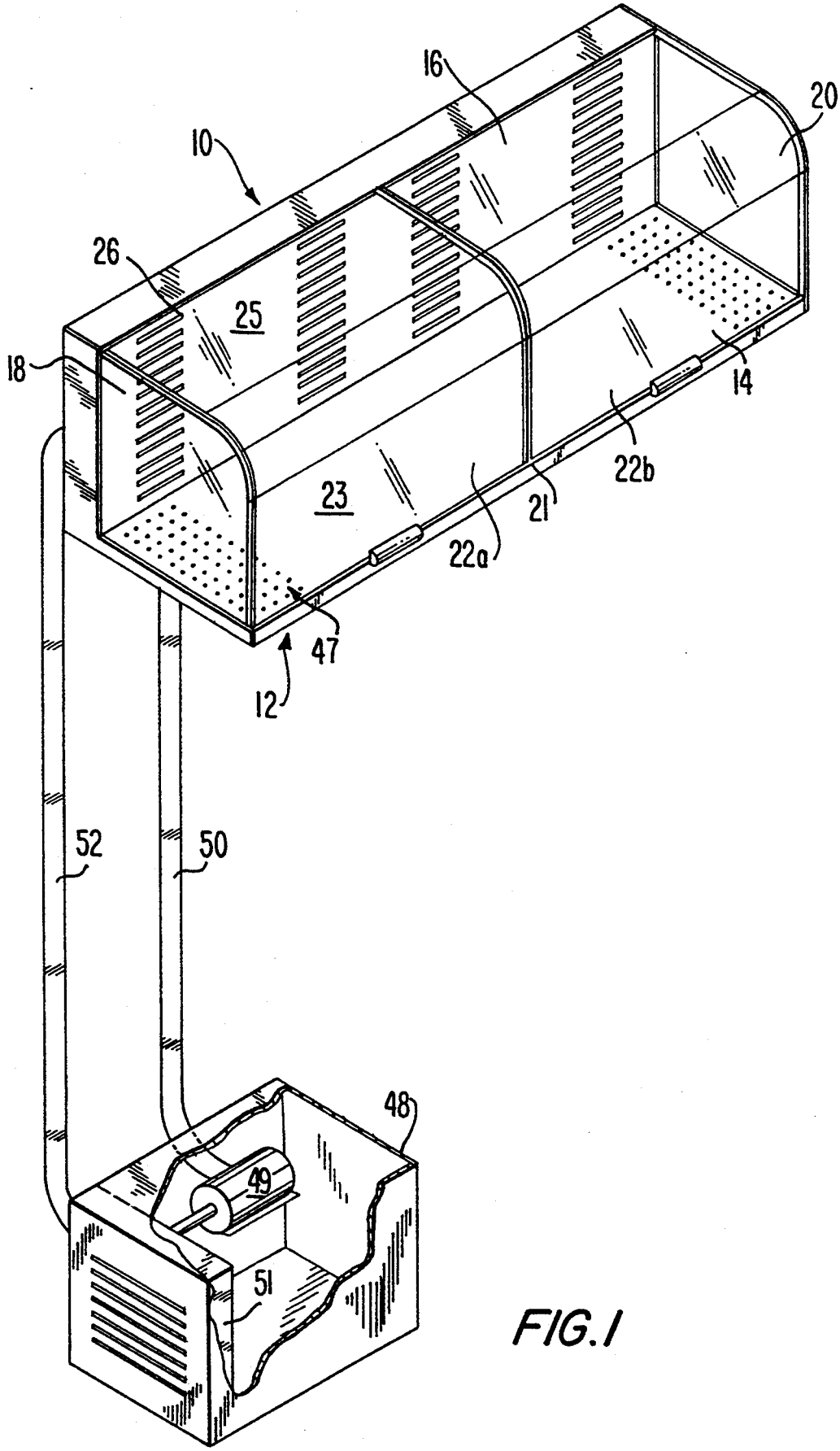
FIG. 1 is an enlarged perspective view showing the construction details of an illustrative embodiment of the present invention.

With initial reference to FIG. 1, there is shown a refrigerated display unit 10 constructed in accordance with one embodiment of the present invention. As seen in FIG. 1, display unit 10 includes a main display housing or bin 12 having an enclosed display area defined by bottom wall 14, rear wall section 16, opposite side members 18 and 20, and first and second transparent covers **22*a* and 22*b* pivotably secured to rear wall section 16 by one or more hinges (not shown). A strip of rigid material 21 extends from the upper interior edge of rear section 16 to the front interior edge of bottom wall 14** and provides support for a lateral edge of each transparent cover.

To enable the consumer to view the interior of covered display bin 12 from all sides, covers **22*a* and 22*b* and side members 18 and 20** are preferably manufactured from a transparent, lightweight material such as plexiglass. A lightweight material is desired to enable the consumer to lift the cover without undue exertion. Although the cover and side members are preferably made from the same material for aesthetic purposes, it should be readily appreciated by those skilled in the art that different materials may be used.

In the illustrated embodiments described herein, transparent covers **22*a* and 22*b* collectively define front and upper interior surface portions 23 and 25 of the enclosed display area, respectively. Side members 18, 20 and covers 22*a* and 22*b* are preferably configured as individual components to keep the weight of the cover to a minimum. However, if a suitably lightweight material having the desired degree of transparency is utilized, it is also possible to construct a single cover having the side members integrally provided thereon, or alternatively, to integrally form side members 18 and 20 as part of individual covers 22*a* and 22*b***, respectively. In any event, as will be readily ascertained by those skilled in the art, suitable gaskets (not shown) may be utilized where appropriate to prevent leakage of refrigerated air from the enclosed display area.

Figure 2:
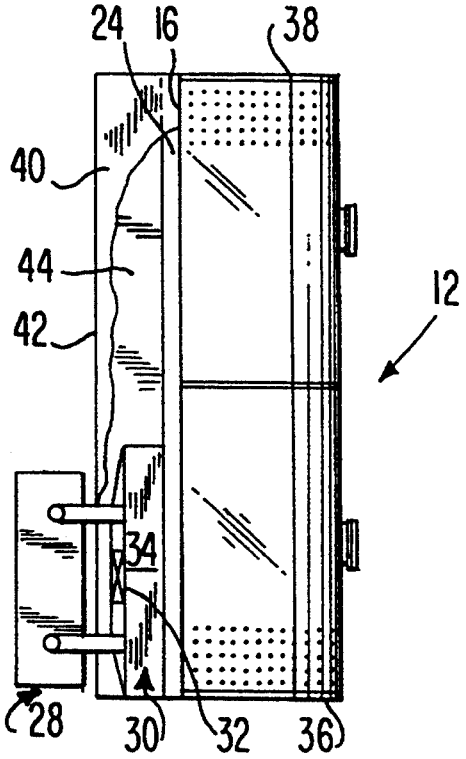
FIG. 2 is partially cut away top view illustrating the internal arrangement of components within the display housing in accordance with the embodiment depicted in FIG. 1.

As more clearly shown in FIG. 2, there is disposed immediately behind rear wall 16 a refrigerated air supply plenum 24 which extends transversely preferably the full width of the main display housing 12. In the illustrative embodiment, rear wall 16 is a common wall separating plenum 24 from the interior of the display area. Passage of refrigerated air from plenum 24 into the display area is thus facilitated by a plurality of elongated apertures or slots 26 defined in rear wall 16 (FIG. 1).

As indicated, above, it is an important object of the present invention to provide a display case which is capable of operating without relying upon an external source of refrigerated air so that it may be positioned on any desired surface for point-of-sale display of goods. As such, display unit 10 utilizes a conventional, thermostat-controlled refrigeration system 28. As will be readily appreciated by those skilled in the art, a conventional refrigeration system includes a compressor, a condenser, a liquid tank, an expansion valve, an evaporator, and an accumulator, all connected in series. Because such systems have long been in use and are deemed to be very well known, a detailed illustration and description of the operation thereof has been omitted herein.

With continuing reference to FIG. 2, it can be seen that the evaporator portion 30 of refrigeration system 28, which portion includes fan 32 and evaporator 34, is positioned immediately behind plenum 24 and supplies refrigerated air thereto. The exterior of main display housing 12 includes exterior side walls 36 and 38, upper wall 40, rear wall 42, and a bottom wall (not shown). Collectively these walls define a chamber 44 for accommodating evaporator portion 30 and plenum 24.

Figure 3:
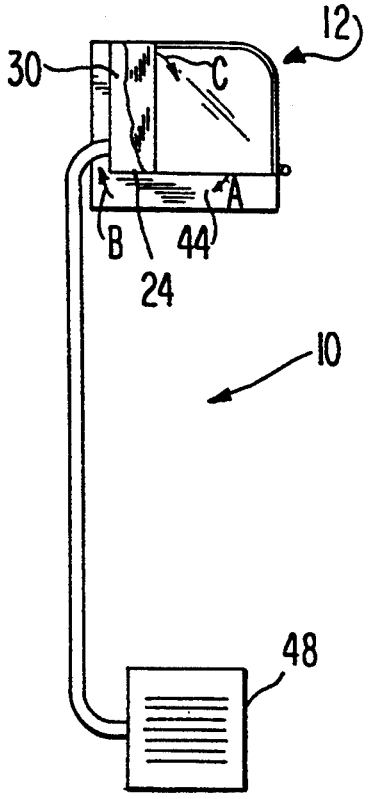
FIG. 3 is a side elevation view partially cut away to illustrate the internal arrangement of components within the display housing in accordance with the embodiment depicted in FIG. 1.

As best seen in FIG. 3, chamber 44 essentially defines a return air plenum communicating with evaporator portion 30 in order to re-cool and re-circulate air within the enclosed display area. For this purpose, a plurality of return air intake openings 47 are formed in bottom wall 14 (FIG. 1). Arrows A, B, and C signify the direction of air flow, with arrow A showing the flow of spent or warm air after it has passed over grocery products (not shown) disposed in the display area of unit 10. The air is recirculated in the direction of the arrows by evaporator fan 32. As will be readily ascertained by those skilled in the art, however, additional fans may be placed in other areas of chamber 44 or within the plenum itself, in order to ensure a uniform flow pattern. After entering chamber 44 via apertures 47, the warmer returned air is diverted upward, as shown by arrow B, between the outer housing rear wall 42 and the evaporator portion 30. The air is re-cooled by evaporator 34, passes through plenum 24, and re-enters the enclosed display area, as shown by arrow C.

Returning to FIG. 1, it will be seen that display unit 10 further includes a remote housing 48 for accommodating the remainder of refrigeration system 28, including the compressor 49 and condenser 51. Placing the condenser, compressor and other elements of the refrigeration system in remote housing 48 reduces the overall size of the system and permits easier access for recharging of refrigerant and other maintenance or repair operations which must typically be performed on such systems. Also provided are first and second fluid connection lines 50 and 52 for supplying refrigerant between the evaporator, compressor, and condenser components. For a purpose which will now be explained, the fluid connection lines are preferably configured as hoses and are made of a flexible material compatible with the refrigerant material being conveyed.

In accordance with the above described embodiment, the main display unit housing can be positioned on any counter or on any shelf which provides sufficient overhead clearance to enable upward pivoting of the cover. Of course, it will be readily appreciated by those skilled in the art that in order to avoid the need for overhead clearance associated with an upwardly pivoting cover, the cover be configured instead as one or more sliding doors.

Figure 4:
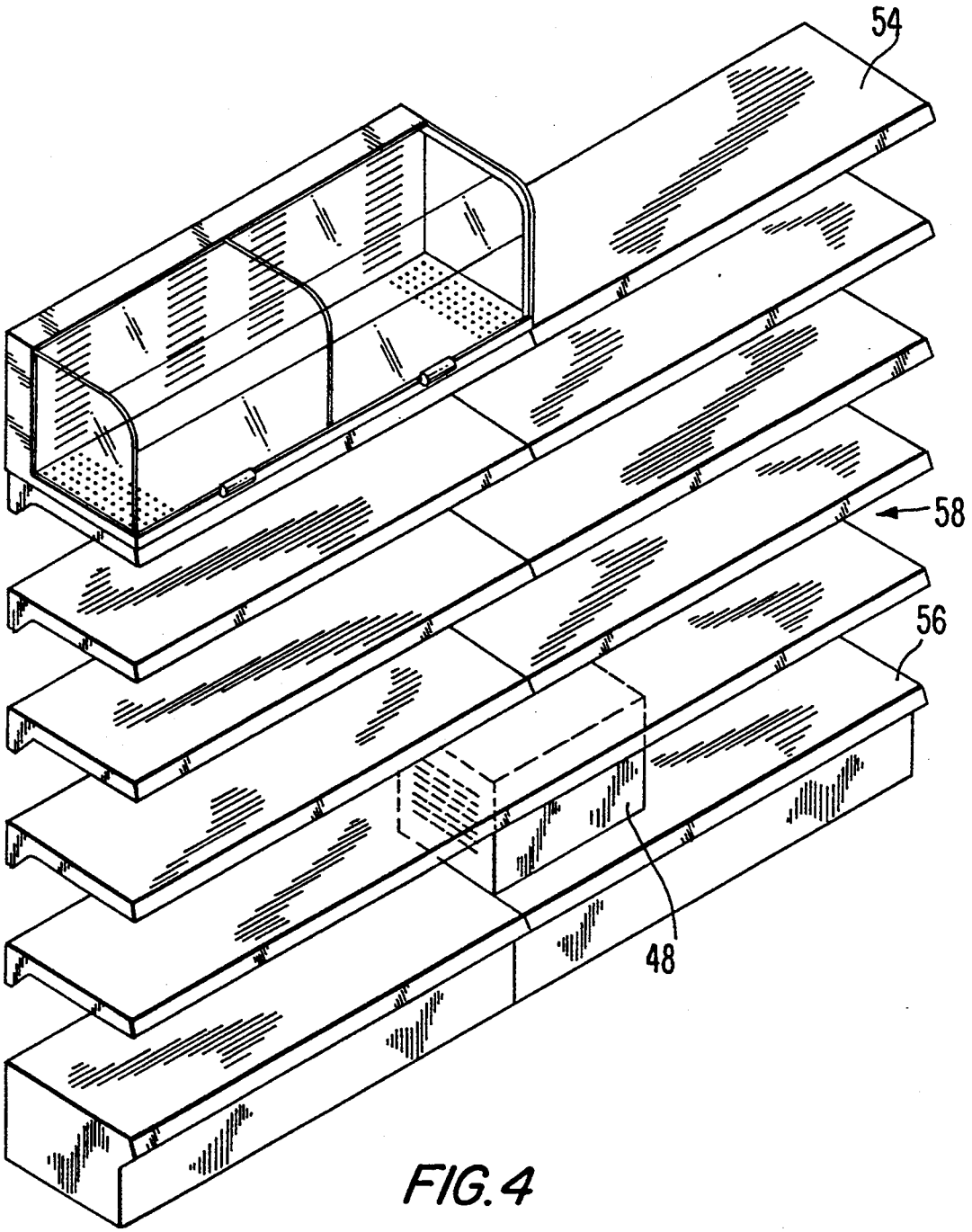
FIG. 4 is a perspective view showing the display unit constructed in accordance with the embodiment of FIG. 1 arranged on a gondola display shelf.

To further enhance the layout flexibility afforded by the display unit of the present invention, the remote housing which contains the compressor and condensing elements of the refrigeration system can be moved to any location where space permits. With reference to FIG. 4, there is shown a typical installation in which main display housing 10 is positioned on the uppermost shelf 54 and remote housing 48 on the base shelf 56 of a gondola display rack system 58. It will, of course, be understood that if space permits, the remote housing may be placed on the same shelf as the main unit, or even suspended directly above the main unit. In any event, it will be readily apparent to those skilled in the art that the flexibility of hoses 50 and 52 permits a wide variety of arrangements which would not be possible if the hoses were constructed of metal or other rigid materials.

Figure 5:
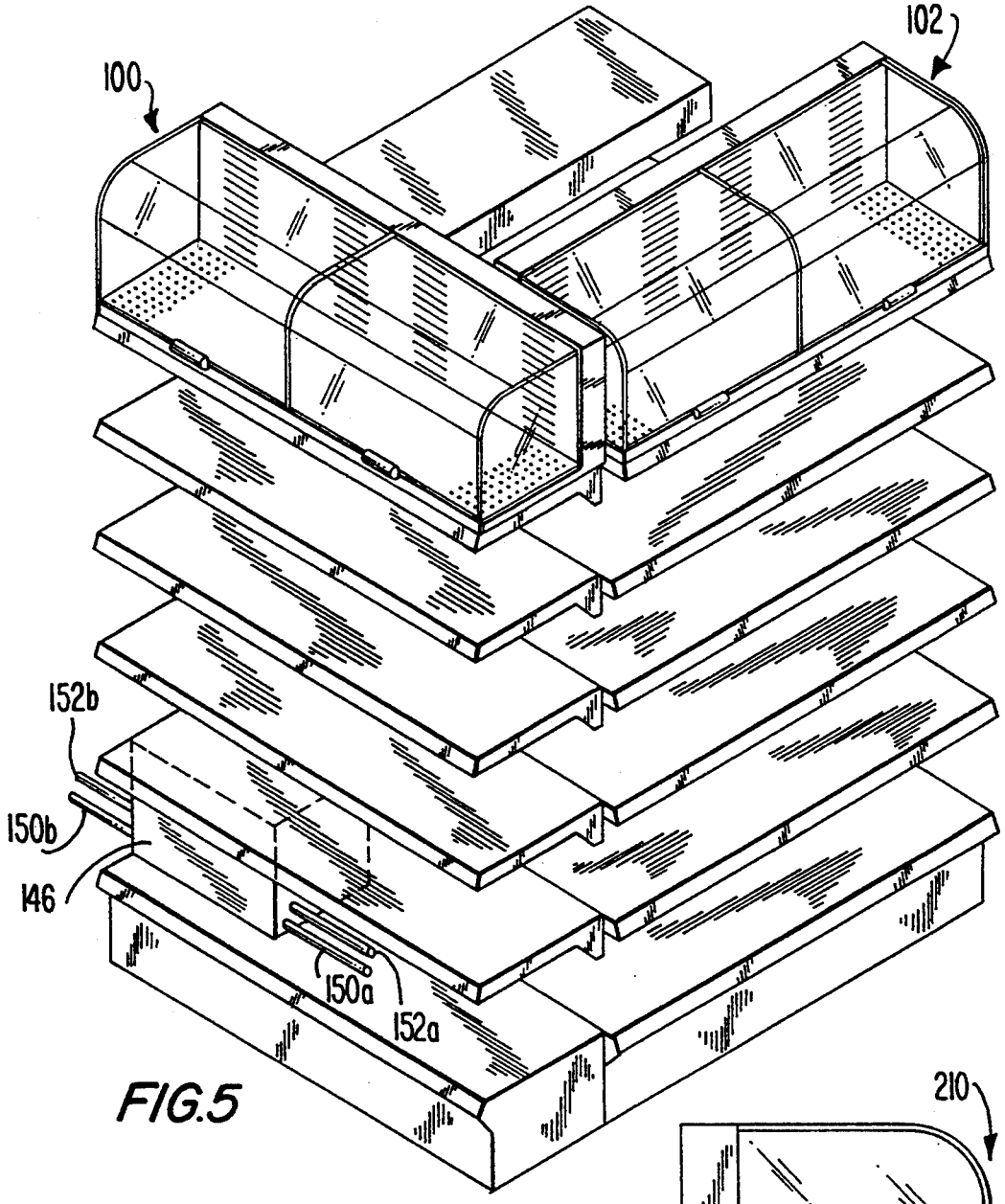
FIG. 5 is a perspective view illustrating a modified embodiment in which two display housings are connected to a single remotely positioned compressor/condenser unit.

Turning to FIG. 5, there is shown a slightly modified embodiment of the display system of the present invention. Specifically, there are shown first and second main display housings 100 and 102, which are each constructed in an identical manner to that described above in connection with housing 10. However, rather than utilizing independent remote housings as remote housing 48 discussed above, the embodiment depicted in FIG. 5 utilizes common compressor and condenser units (not shown) located in a single housing 146. The evaporator sections (not shown) of each main display housing are connected to the common compressor and condenser units by flexible hoses 150*a*, 152*a* and 150*b* and 152*b*, respectively, in a manner similar to that described above except that suitable means, such as corresponding "T" connectors (not shown), must be utilized to connect hoses 150*a*, 150*b* and 152*a*, 152*b* to the common compressor and condenser units, respectively.

Figure 6:
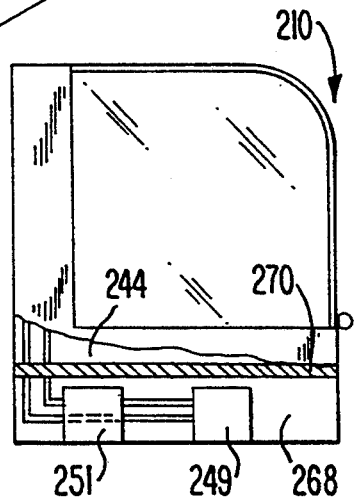
FIG. 6 is a partially cut away side elevation view of a further embodiment of the present invention in which the condenser, evaporator and compressor are all arranged within the display housing.

In FIG. 6 there is illustrated a display unit 210 in accordance with another embodiment of the present invention. The construction of the embodiment presented in FIG. 6 is, in every material respect, identical to the embodiment depicted in FIGS. 1–4, except that instead of utilizing a remote housing and the flexible refrigerant connections attendant therewith, compressor 249 and condenser 251 are disposed within a second chamber 268 separated from chamber 244. To prevent heat released by condenser unit 251 from increasing the temperature of air recirculating within chamber 244, an insulating barrier 270 is preferably provided therebetween. Although chamber 268 is shown positioned beneath chamber 244, it may, in fact, be positioned over the top, or adjacent the side walls, of chamber 244, if desired.

The display system of this invention is particularly suited for the display of beverages wherein it is necessary to provide both easy access to the display and a sufficient cooling capacity so that they are maintained at a temperature desirable for immediate consumption. However, although the air flow across the articles to be displayed provides a highly desirable shelf-mounted display case for beverages, it will be obvious to those skilled in the art that other items could be displayed, and this invention is not intended to be limited to displaying beverages.

It should also be understood that the preferred embodiments and examples described are for illustrative purposes only and are not to be construed as limiting the scope of the present invention which is properly delineated only in the appended claims.

What is claimed is:

1. A refrigerated display unit comprising:

a main display housing defining a display area having a bottom interior surface, opposed interior side surfaces, and a rear interior surface, a first chamber which includes a first section disposed beneath said bottom interior surface and a second section disposed behind said rear interior surface, said first and second sections being in fluid communication to permit air flow therebetween, said main display housing further defining a second chamber adjacent to said first chamber, and including a transparent cover means for enclosing said display area; and means or supplying refrigerated air to said display area, said supplying means including an evaporator and a fan disposed within said second chamber for moving air through said evaporator for cooling said air, wherein said rear interior surface defines a supply duct for ejecting said refrigerated air to said display area and said bottom interior surface defines a return duct for exhausting spent air from said display area to said second chamber and wherein said fan is positioned for blowing said cooled air through said supply duct to said display area.

2. A refrigerated display unit according to claim 1, wherein said supplying means further includes a plenum interposed between said rear interior surface and the second section of said chamber for receiving refrigerated air from said evaporator and supplying said refrigerated air to said display area.

3. A refrigerated display unit according to claim 1, wherein said intake duct comprises a plurality of elongated slots defined in said first interior surface.

4. A refrigerated display unit according to claim 1, wherein said exhaust duct comprises a plurality of apertures defined in said second interior surface.

5. A refrigerated display unit according to claim 1, wherein said first and second interior side surfaces are defined by said transparent cover means.

6. A refrigerated display unit according to claim 1, wherein said transparent cover means includes first and second cover sections, each of said cover sections defining upper and front interior surface portions of said display area.

7. A refrigerated display unit according to claim 6, wherein said transparent cover means further includes a support member disposed above said bottom interior surface for supporting respective edge portions of said first and second cover sections.

8. A refrigerated display unit according to claim 1, wherein said transparent cover means defines top and front interior surfaces of the display area.

9. The refrigerated display unit according to claim 1, wherein said second chamber is disposed below said first section of said first chamber.

10. The refrigerated display unit according to claim 1, wherein said supplying means further comprises a condenser and a compressor unit coupled to said evaporator.

11. A refrigerated display unit according to claim 10, further including insulating means interposed between said chambers for insulating air recirculated within the first chamber from heat released by the condenser unit.

* * * * *